US010732543B2

(12) United States Patent
Sakata

(10) Patent No.: US 10,732,543 B2
(45) Date of Patent: Aug. 4, 2020

(54) TONER CARTRIDGE

(71) Applicant: BROTHER KOGYO KABUSHIKI KAISHA, Nagoya-shi, Aichi (JP)

(72) Inventor: Isamu Sakata, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/313,586

(22) PCT Filed: Jul. 13, 2017

(86) PCT No.: PCT/JP2017/025523

§ 371 (c)(1),
(2) Date: Dec. 27, 2018

(87) PCT Pub. No.: WO2018/012580

PCT Pub. Date: Jan. 18, 2018

(65) Prior Publication Data

US 2019/0391510 A1 Dec. 26, 2019

(30) Foreign Application Priority Data

Jul. 14, 2016 (JP) ..... 2016-139658

(51) Int. Cl.
*G03G 15/08* (2006.01)
*G03G 15/00* (2006.01)

(52) U.S. Cl.
CPC ..... *G03G 15/0868* (2013.01); *G03G 15/0872* (2013.01); *G03G 15/0881* (2013.01);
(Continued)

(58) Field of Classification Search
None
See application file for complete search history.

(56) References Cited

U.S. PATENT DOCUMENTS

2005/0117937 A1 6/2005 Jeon
2008/0298834 A1* 12/2008 Hasegawa ..... G03G 15/0875 399/106

(Continued)

FOREIGN PATENT DOCUMENTS

EP 2 565 720 A2 3/2013
JP 8-292634 A 11/1996

(Continued)

OTHER PUBLICATIONS

JP_2014149519_A_T Japan, Furuya, Aug. 2014 (Year: 2014).*

(Continued)

*Primary Examiner* — Victor Verbitsky
(74) *Attorney, Agent, or Firm* — Merchant & Gould P.C.

(57) ABSTRACT

Providing a toner cartridge capable of restraining toner from leaking through an opening, and improving labor efficiency for assembling the cartridge. The toner cartridge (process cartridge 1) includes a developing frame having a storage chamber configured to store therein toner and formed with an opening to discharge the toner out of the storage chamber, a shaft rotatably supported to the developing frame; and an agitation sheet positioned in the storage chamber and having a base end portion supported to the shaft, the agitation sheet being rotationally movable along with rotation of the shaft. The developing frame includes a first wall formed with the opening, and a second wall configured to support the agitation sheet by nipping the agitation sheet positioned to close the opening between the first wall and the second wall, the second wall permitting the agitation sheet to contact with the first wall and contacting with the agitation sheet through an elastic member.

13 Claims, 9 Drawing Sheets

(52) U.S. Cl.
CPC ..... *G03G 15/0889* (2013.01); *G03G 15/6502* (2013.01); *G03G 2215/0665* (2013.01); *G03G 2215/0802* (2013.01)

(56) References Cited

U.S. PATENT DOCUMENTS

| | | | |
|---|---|---|---|
| 2013/0308973 | A1 | 11/2013 | Kashiide et al. |
| 2013/0322926 | A1 | 12/2013 | Matsunaga et al. |
| 2013/0343785 | A1 | 12/2013 | Matsuzaki et al. |
| 2014/0029974 | A1 | 1/2014 | Uesugi et al. |
| 2014/0072345 | A1 | 3/2014 | Matsunaga et al. |
| 2014/0072347 | A1 | 3/2014 | Furutani et al. |
| 2014/0079432 | A1 | 3/2014 | Matsuzaki et al. |
| 2014/0093272 | A1 | 4/2014 | Matsumaru et al. |
| 2014/0126928 | A1 | 5/2014 | Batori et al. |
| 2014/0212166 | A1 | 7/2014 | Takeuchi et al. |
| 2014/0356020 | A1 | 12/2014 | Murakami et al. |
| 2014/0376955 | A1 | 12/2014 | Takeuchi |
| 2015/0003865 | A1 | 1/2015 | Batori et al. |
| 2015/0205226 | A1 | 7/2015 | Komatsu et al. |
| 2016/0062270 | A1 | 3/2016 | Fukasawa et al. |

FOREIGN PATENT DOCUMENTS

| | | | |
|---|---|---|---|
| JP | 2002-244422 | A | 8/2002 |
| JP | 2006-276532 | A | 10/2006 |
| JP | 2013-250344 | A | 12/2013 |
| JP | 2014-032425 | A | 2/2014 |
| JP | 2014-032426 | A | 2/2014 |
| JP | 2014-056025 | A | 3/2014 |
| JP | 2014-067002 | A | 4/2014 |
| JP | 2014-071275 | A | 4/2014 |
| JP | 2014-074895 | A | 4/2014 |
| JP | 2014-112206 | A | 6/2014 |
| JP | 2014-149519 | A | 8/2014 |
| JP | 2014-167606 | A | 9/2014 |
| JP | 2014-235249 | A | 12/2014 |
| JP | 2015-007662 | A | 1/2015 |
| JP | 2015-011110 | A | 1/2015 |
| JP | 2015-129782 | A | 7/2015 |
| JP | 2015-129798 | A | 7/2015 |
| JP | 2015-148738 | A | 8/2015 |
| JP | 2015-187718 | A | 10/2015 |
| JP | 2016-051051 | A | 4/2016 |

OTHER PUBLICATIONS

International Search Report and Written Opinion from International Application No. PCT/JP2017/025523, dated Aug. 29, 2017.

International Preliminary Report on Patentability issued in related International Patent Application No. PCT/JP2017/025523, dated Jan. 24, 2019.

Extended European Search Report issued in corresponding European Patent Application No. 17827703.4, dated Jan. 31, 2020.

Office Action issued in correspondence Japanese Patent Application No. 2016-139658, dated Apr. 28, 2020.

* cited by examiner

TONER CARTRIDGE

This application is a National Stage Application of PCT/JP2017/025523, filed Jul. 13, 2017, which claims benefit of Serial No. 2016-139658, filed Jul. 14, 2016 in Japan and which applications are incorporated herein by reference. To the extent appropriate, a claim of priority is made to each of the above disclosed applications.

TECHNICAL FIELD

The present disclosure relates to a toner cartridge including a toner storage chamber for storing therein toner.

BACKGROUND

There is conventionally known a cartridge including a toner storage chamber, a developing chamber, and a conveying unit (see Patent Document 1). The developing chamber accommodates therein a developing roller configured to carry toner conveyed from the storage chamber through an opening. The conveying unit is configured to convey toner in the storage chamber toward the developing chamber. In the cartridge, the conveying unit includes a rotatable shaft, a conveying sheet attached to the shaft, and a seal member having a base end portion attached to the shaft and a free end portion configured to block the opening. Rotation of the shaft peels off the seal member from a wall forming the opening to open the opening, and rotationally moves the conveying sheet to convey the toner in the storage chamber toward the developing chamber.

PRIOR ART DOCUMENT

[Patent Document 1] Japanese Patent Application Publication No. 2015-187718

SUMMARY OF THE INVENTION

Problem to be Solved in the Invention

According to the conventional cartridge, leakage of the toner through the opening can be restrained because the seal member blocks the opening. However, troublesome labor for assembling the cartridge is required, since the seal member is attached to the wall forming the opening by fuse-bonding.

In view of the foregoing, it is an object of the present invention to provide a cartridge capable of restraining toner leakage through the opening, yet enhancing assembling efficiency.

Means for Solving the Problem

In order to attain the above described object, the toner cartridge according to the present invention includes a toner cartridge including a casing having a storage chamber configured to store therein toner and formed with an opening to discharge the toner out of the storage chamber, a shaft rotatably supported to the casing, and a flexible sheet positioned in the storage chamber and having a base end portion supported to the shaft, the flexible sheet being rotationally movable along with rotation of the shaft. The casing includes a first wall formed with the opening, and a second wall configured to contact with the flexible sheet while permitting the flexible sheet to be in contact with the first wall by nipping, in cooperation with the first wall, the flexible sheet positioned to close the opening, to thus support, in cooperation with the first wall, the flexible sheet positioned to close the opening.

With this structure, leakage of the toner through the opening can be restrained, since the flexible sheet closes the opening without fuse-bonding between the flexible sheet and a wall forming the opening. Further, in the process of assembling the toner cartridge 1, fuse-bonding of the flexible sheet to the wall forming the opening is not required. Therefore, assembling labor efficiency can be improved.

Effect of the Invention

According to the present invention, improvement on assembling labor efficiency can be obtained while restraining toner leakage through the opening.

EMBODIMENT

Figure 1:
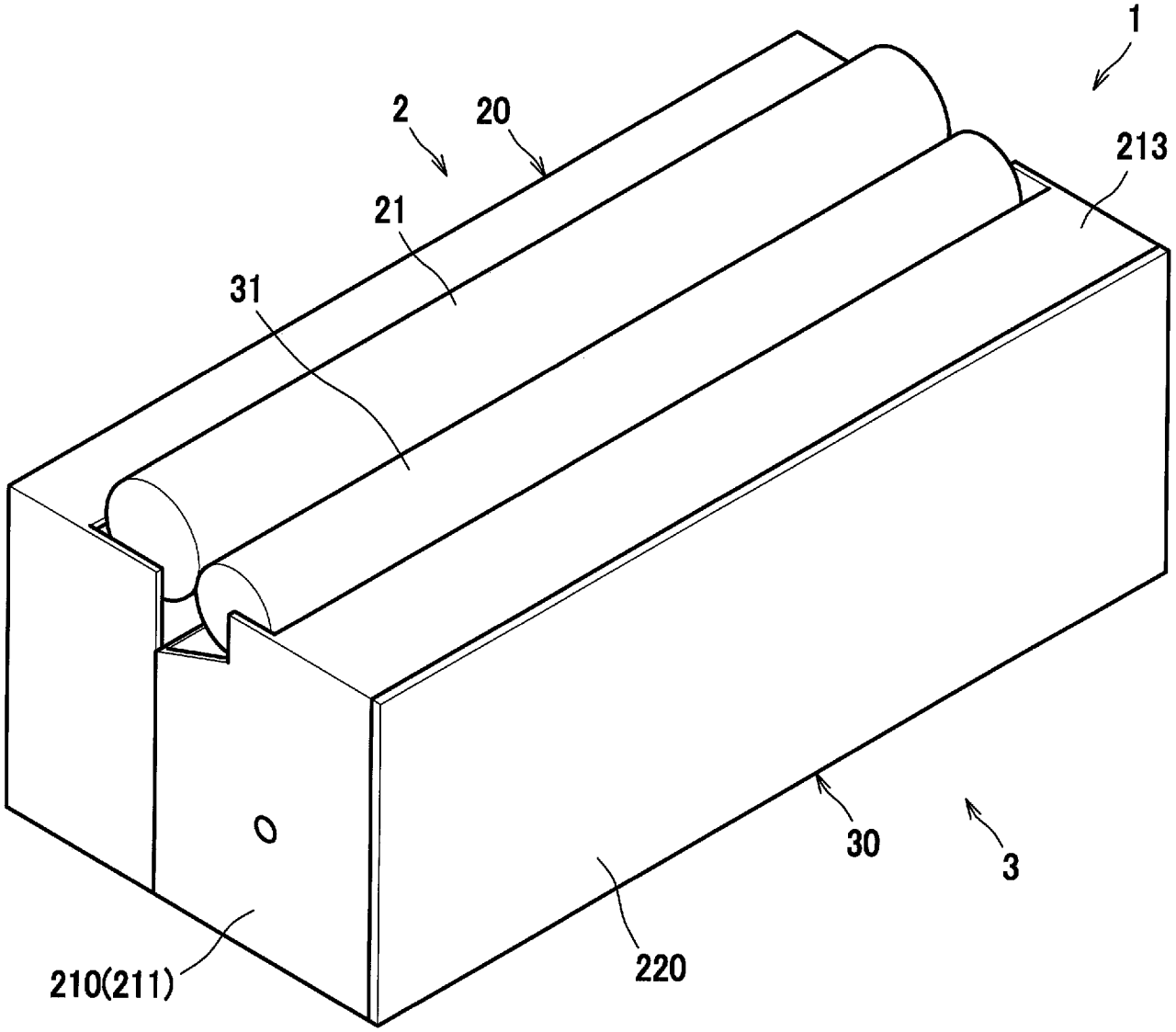
FIG. 1 is a perspective view of a process cartridge as an example of a toner cartridge.

A process cartridge 1 as an example of a toner cartridge according to a first embodiment will be described while referring to the accompanying drawings. As shown in FIG. 1, the process cartridge 1 includes a drum unit 2 including a photosensitive drum 21 and a developing unit 3 including a developing roller 31.

Figure 2:
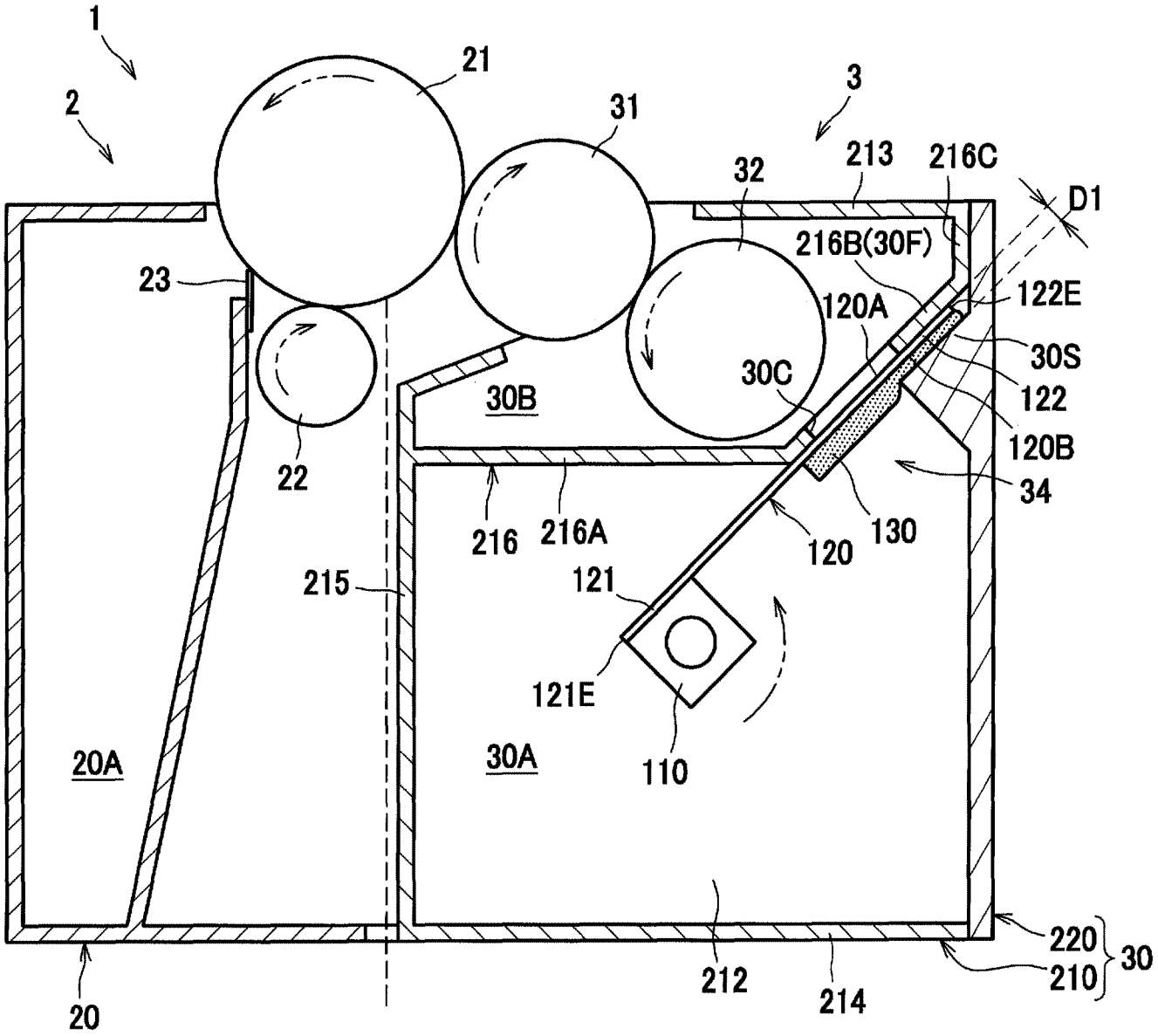
FIG. 2 is a cross-sectional view of the process cartridge according to a first embodiment.

As illustrated in FIG. 2, the drum unit 2 includes a drum frame 20, the photosensitive drum 21, a charge roller 22, and a cleaning blade 23. The photosensitive drum 21 includes a hollow cylindrical drum body having electrical conductivity, and a photosensitive layer formed over an outer peripheral surface of the drum body. The photosensitive drum 21 is rotatably supported to the drum frame 20. The charge roller 22 is configured to uniformly charge the surface of the photosensitive drum 21, and is rotatably supported to the drum frame 20.

The cleaning blade 23 is configured to scrape off toner adhered to the surface of the photosensitive drum 21 for cleaning the surface of the photosensitive drum 21. The cleaning blade 23 is disposed to be in sliding contact with the surface of the rotating photosensitive drum 21. The drum frame 20 is configured to support the photosensitive drum 21, the charge roller 22, and the cleaning blade 23. The drum frame 20 provides therein a waste toner storage chamber 20A for collecting the toner scraped off by the cleaning blade 23.

The developing unit 3 includes a developing frame 30 as an example of a casing, a developing roller 31, a supply roller 32, and an agitator 34. The developing roller 31 is configured to carry toner on its surface to supply toner to an electrostatic latent image formed on the surface of the photosensitive drum 21. The supply roller 32 is configured to supply toner to the developing roller 31.

The agitator 34 is configured to agitate toner stored in the developing unit 3 and to supply the toner to the supply roller 32. The developing frame 30 is configured to rotatably support the developing roller 31, the supply roller 32, and the agitator 34. The developing frame 30 defines therein a storage chamber 30A for storing toner. Details of the developing frame 30 and the agitator 34 will be described later.

In the process cartridge 1 thus constructed, the surface of the photosensitive drum 21 rotated in a prescribed rotating direction is uniformly charged by the charge roller 22, and then the surface is exposed to light as indicated by a broken line in FIG. 1 emitted from an exposure unit (not illustrated) to form an electrostatic latent image on the surface of the photosensitive drum 21. On the other hand, the toner accommodated in the storage chamber 30A is supplied to the supply roller 32 while being agitated by the agitator 34, and then the toner is supplied from the supply roller 32 to the developing roller 31 and carried on the surface of the developing roller 31.

Then, the toner carried on the surface of the developing roller 31 is supplied to the electrostatic latent image formed on the surface of the photosensitive drum 21, so that the latent image becomes visible toner image. The toner image is then transferred directly to a recording medium such as a sheet or indirectly to the sheet through an intermediate transfer medium. Toner remaining on the surface of the photosensitive drum 21 is scraped off by the cleaning blade 23 and is collected in the waste toner storage chamber 20A.

The agitator 34 includes a shaft 110, an agitation sheet 120 as an example of a flexible sheet, and an elastic member 130. The shaft 110 extends in an extending direction of a rotation axis of the developing roller 31, and is rotatably supported to the developing frame 30. The shaft 110 is rotatable in a counterclockwise direction in FIG. 2 upon input of driving force from a drive source such as a motor not illustrated. In the following description, extending direction of the rotation axis of the shaft 110 will be referred to as axial direction.

The agitation sheet 120 is a flexible sheet made from resin. The agitation sheet 120 is rectangular shaped elongated in the axial direction. The agitation sheet 120 is positioned in the storage chamber 30A, and has a base end portion 121 supported to the shaft 110. Specifically, the agitation sheet 120 is fixed to the shaft 110 by an adhesive agent. The agitation sheet 120 has a free end portion 122 in sliding contact with an inner surface of the storage chamber 30A. The agitation sheet 120 moves about the axis of the shaft 110 by the counterclockwise rotation of the shaft 110 thereby agitating toner in the storage chamber 30A and supplying toner to a developing chamber 30B described later.

The agitation sheet 120 has a first surface 120A with which toner is conveyed by the rotation of the shaft 110, and a second surface 120B opposite to the first surface 120A. Specifically, in a state where the agitation sheet 120 is nippingly supported between a first wall 30F (described later) and a second wall 30S (described later) of the developing frame 30 as illustrated in FIG. 2, the first surface 120A is in contact with the first wall 30F, and the second surface 120B is in contact with the second wall 30S through the elastic member 130.

Figure 3A:
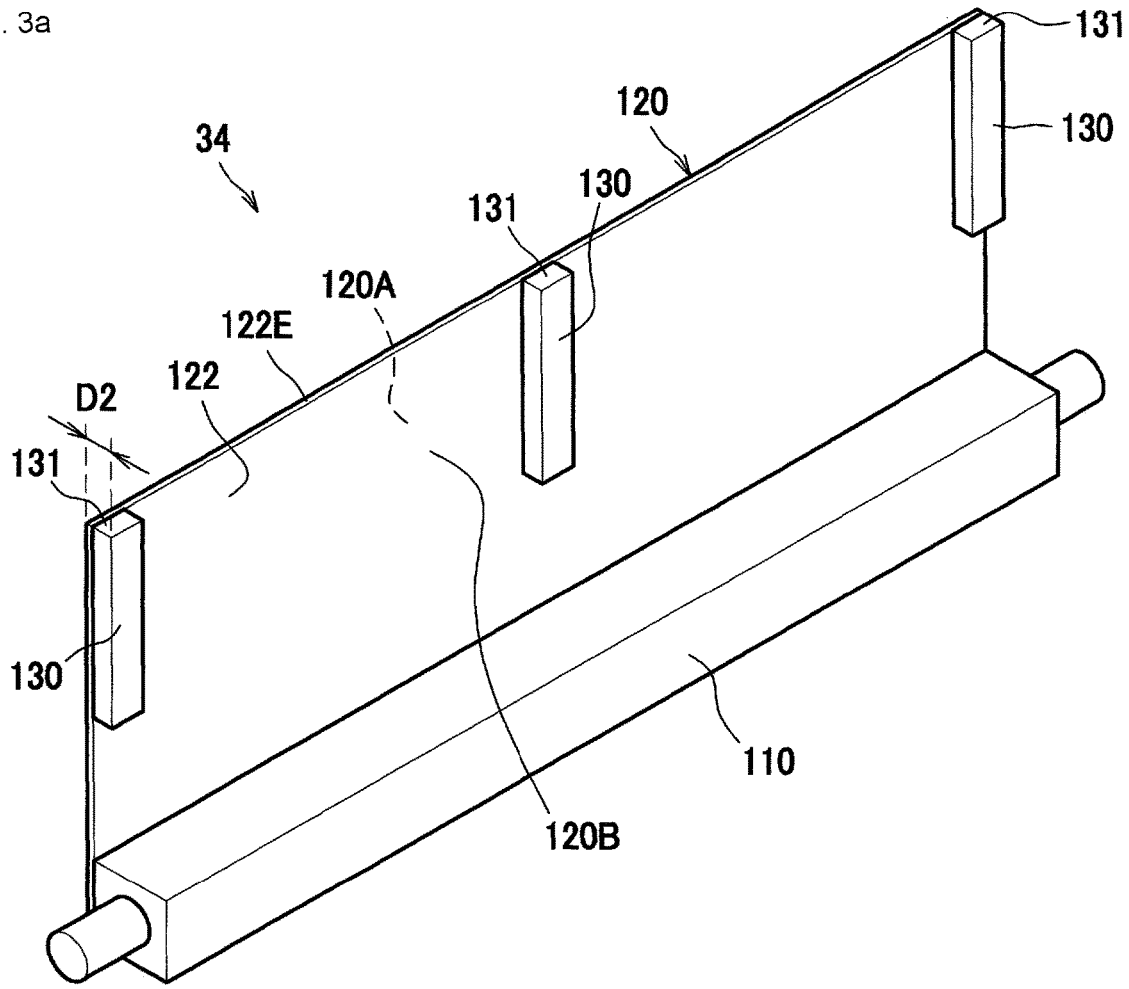
FIG. 3A is a perspective view of an agitator in the toner cartridge according to the embodiment.

As illustrated in FIG. 3A, the elastic member 130 is block shaped and elastically deformable. The elastic member 130 is made from urethane foam, for example. The elastic member 130 is disposed at the second surface 120B and is fixed thereto by an adhesive agent. Further, the elastic member 130 is positioned at a free end portion 122 of the agitation sheet 120. Specifically, the elastic member 130 has an end face 131 in a direction perpendicular to the axial direction in a non-flexed state of the elastic member 120, and the end face 131 is aligned with a free end 122E of the agitation sheet 120. In this state, the elastic member 130 is positioned on the agitation sheet 120 so as to extends from the free end 122E to a base end 122F (FIG. 2) of the agitation sheet 120. Three elastic members 130 are provided in such a manner that each of the two elastic members is positioned at each end portion in the axial direction of the agitation sheet 120, and one elastic member 130 is positioned at a center portion in the axial direction of the agitation sheet 120.

Figure 3B:
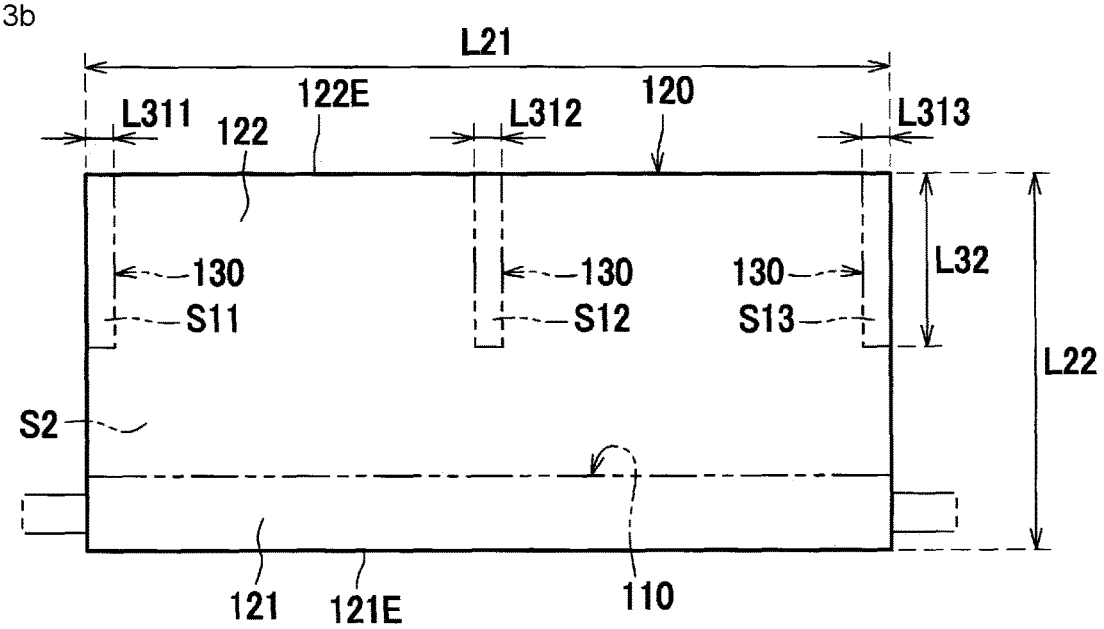
FIG. 3B is a view illustrating a first surface of an agitation sheet of the agitator.

As illustrated in FIG. 3B, preferably, a length L31 (not illustrated) in the axial direction which is a sum of lengths L311, L312 and L313 in the axial direction of the three elastic members 130 is in a range of from 10 to 100% of a length L21 in the axial direction of the agitation sheet 120. In the present embodiment, the total length L31 which is the sum of lengths L311, L312 and L313 is about 10% of the length L21 of the agitation sheet 120.

Further, preferably, the elastic member 130 has a length L32 ranging from 15 to 70% of a length L22 of the agitation sheet 120 in the direction perpendicular to the axial direction in the non-flexed state. In the present embodiment, the length L32 of the elastic member 130 is about 50% of the length L22 of the agitation sheet 120.

Further, preferably, an area S1 (not illustrated) of the agitation sheet 120 occupied by the elastic members 130, in other word, the area S1 which is a sum of areas S11, S12 and S13 where the elastic members 130 are disposed is in a range of from 2 to 50% of an entire area S2 of the agitation sheet 120. In the present embodiment, the occupied area S1 which is the sum of areas S11, S12 and S13 is about 5% of the entire area S2 of the agitation sheet 120.

As illustrated in FIG. 2, a portion of the elastic member 130 located adjacent to the free end portion 122E of the agitation sheet 120 is positioned between the agitation sheet 120 and the second wall 30S in a state where the agitation sheet 120 is nippingly supported between the first wall 30F and the second wall 30S of the developing frame 30.

The developing frame 30 defines therein a storage chamber 30A for storing toner and a developing chamber 30B for accommodating therein the developing roller 31 and the supply roller 32. The developing frame 30 mainly includes a first developing frame 210 and a second developing frame 220.

The first developing frame 210 mainly includes a first side wall 211 (see FIG. 1), a second side wall 212 facing the first side wall 211 in the axial direction, a third side wall 213 connecting ends of the first and second side walls 211, 212 together, a fourth side wall 214 facing the third side wall 213 in a direction perpendicular to the axial direction and connecting another ends of the first and second side walls 211, 212 together, a fifth side wall 215 connecting ends of the side walls 211, 212, 214 together, the ends being opposite ends at which the second developing frame 220 is positioned, and a partitioning wall 216 partitioning the storage chamber 30A from the developing chamber 30B. The first developing frame 210 has an open end to which the second developing fame 220 is to be attached. The open end functions as an attachment opening 217 (see FIG. 4) for installing the agitator 34 in the storage chamber 30A.

The storage chamber 30A is constituted by the first side wall 211, the second side wall 212, the fourth side wall 214, the fifth side wall 215, the partitioning wall 216, and the second developing frame 220. Further, the developing chamber 30B is constituted by the first side wall 211, the second side wall 212, the third side wall 213, the fifth side wall 215, and the partitioning wall 216.

The partitioning wall 216 includes a first part 216A extending from the fifth side wall 215, a second part 216B obliquely extending from an end of the first part 216A, and a third part 216C extending from an end of the second part 216B and connected to an end of the third side wall 213. The second part 216B of the partitioning wall 216 is the first wall 30F where an opening 30C is formed allowing communication between the storage chamber 30A and the developing chamber 30B. The opening 30C is configured to supply toner in the storage chamber 30A to an outside of the storage chamber 30A, i.e., to the developing chamber 30B.

The second developing frame 220 constitutes a wall of the storage chamber 30A in cooperation with the first developing frame 210, and is disposed to cover the attachment opening 217 (see FIG. 4) of the first developing frame 210. The second developing frame 220 is fixed to the side walls 211 to 214 of the first developing frame 210 and to the third part 216C of the partitioning wall 216 by adhesive agent or fuse-bonding. The second developing frame 220 includes the second wall 30S facing the first wall 30F with a predetermined interval D1.

The second wall 30S supports, in cooperation with the first wall 30F, the agitation sheet 120 positioned to close the opening 30C and to extends in approximately parallel to the first wall 30F. Specifically, the second wall 30S nippingly supports, in cooperation with the first wall 30F, the end portion 122 of the agitation sheet 120 and the elastic member 130 extending in approximately parallel to the first wall 30F. More specifically, the second wall 30S is provided so as to nip the agitation sheet 120 between the second wall 30S and the first wall 30F in such a manner that the first surface 120A of the agitation sheet 120 is in contact with the first wall 30F while the second wall 30S is in contact with the second surface 120B of the agitation sheet 120 through the elastic member 130.

A gap distance D1 between the first wall 30F and the second wall 30S is smaller than a thickness D2 (see FIG. 3A) which is sum of the thickness of the agitation sheet 120 and the elastic member 130. Hence, the elastic member 130 is partly pressed and elastically deformed in the state where the agitation sheet 120 and the elastic member 130 are nippingly supported between the first wall 30F and the second wall 30S.

Figure 4A:
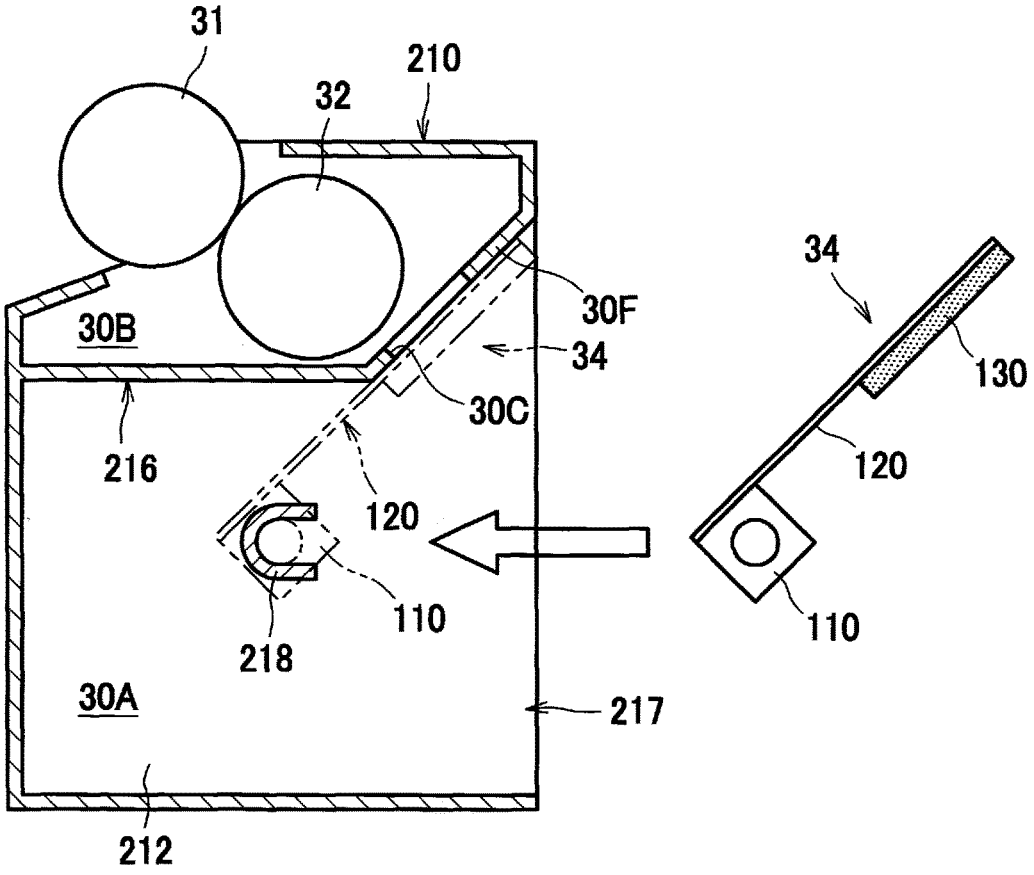
FIGS. 4A and 4B are views for description of a process for assembling the process cartridge.

Next, a process for assembling the process cartridge 1 will be described. At first, as illustrated in FIG. 4A, the developing roller 31, the supply roller 32, and the agitator 34 are assembled to the first developing frame 210.

The agitator 34 is positioned in the storage chamber 30A through the attachment opening 217 of the first developing frame 210. Each of the first side frame 211 (see FIG. 2) and the second side frame 212 is provided with a bearing portion 218, and each end portion of the shaft 110 is rotatably engaged with each bearing portion 218, thereby attaching the agitator 34 to the first developing frame 210. Then, the agitator 34 is rotated as needed so that the agitator 34 has a posture such that the agitation sheet 120 is directed approximately parallel to the first wall 30F of the first developing frame 210, in other word, the agitation sheet 120 closes the opening 30C of the first wall 30F.

Figure 4B:
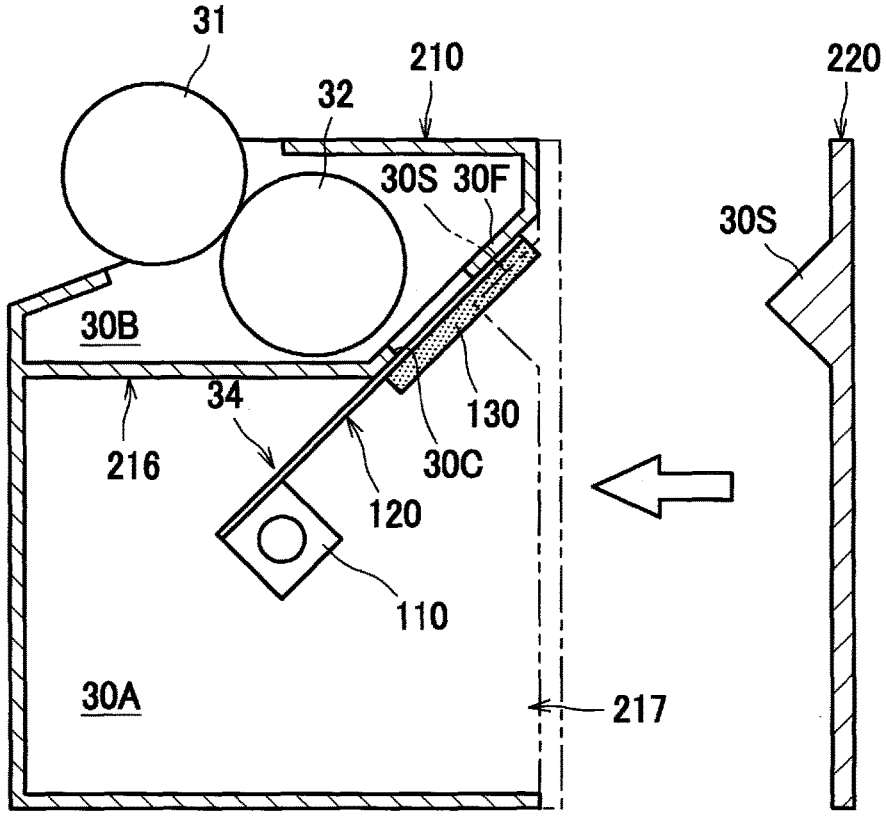

Then, as illustrated in FIG. 4B, the second developing frame 220 is attached to the first developing frame 210 so as to close the attachment opening 217. In this case, the agitation sheet 120 and the elastic member 130 are nipped between the first wall 30F and the second wall 30S of the second developing frame 220. That is, one surface of the elastic member 130 is in contact with the agitation sheet 120, and another surface of the elastic member 130 is in contact with the second developing frame 220. Then, the second developing frame 220 is fixed to the first developing frame 210 by an adhesive agent or fuse-bonding, whereupon the part of the elastic member 130 is pressedly elastically deformed as illustrated in FIG. 2. With this state, the agitation sheet 120 and the elastic member 130 are supported between the first wall 30F and the second wall 30S.

Then, the developing unit 3 and the drum unit 2 are assembled together to provide the process cartridge 1. Then, toner is filled in the storage chamber 30A through a filling port (not illustrated) formed in the developing frame 30.

Next, operation of the agitator 34 will be described. Upon input of driving force to the shaft 110 of a new cartridge illustrated in FIG. 2, the shaft 110 rotates in the counterclockwise direction in FIG. 2 to rotationally move the agitation sheet 120.

Figure 5A:
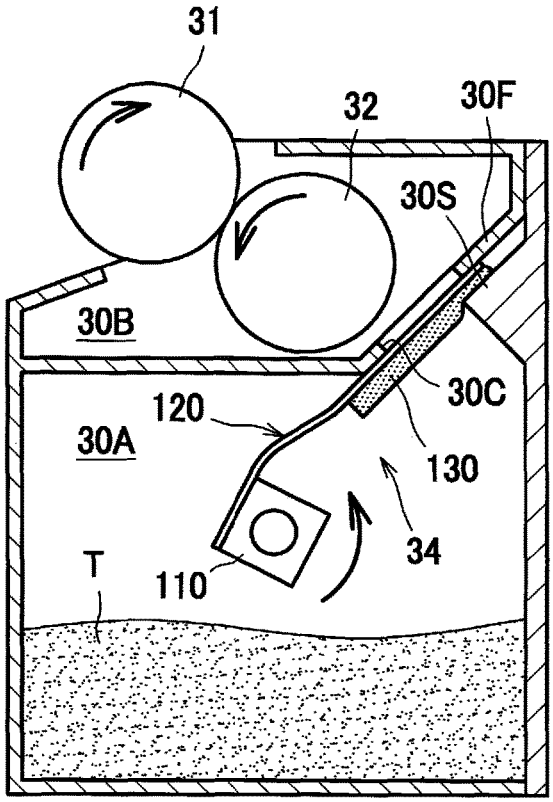
FIG. 5A through 5C are views for description of operational states of the agitator.
Figure 5B:
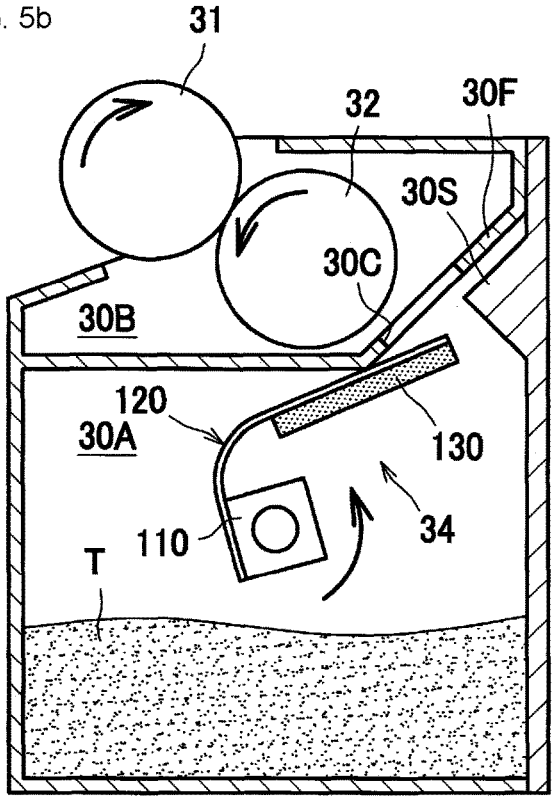

Then, as illustrated in FIG. 5A, the agitation sheet 120 and the elastic member 130 are gradually pulled out of the gap between the first wall 30F and the second wall 30S. Then, in accordance with a predetermined angular rotation of the shaft 110 from the initial position in FIG. 2 to the position illustrated in FIG. 5B, the agitation sheet 120 and the elastic member 130 are completely pulled out of the gap between the first wall 30F and the second wall 30S. Thus, the opening 30C of the first wall 30F is opened providing communication between the storage chamber 30A and the developing chamber 30B through the opening 30C.

Figure 5C:
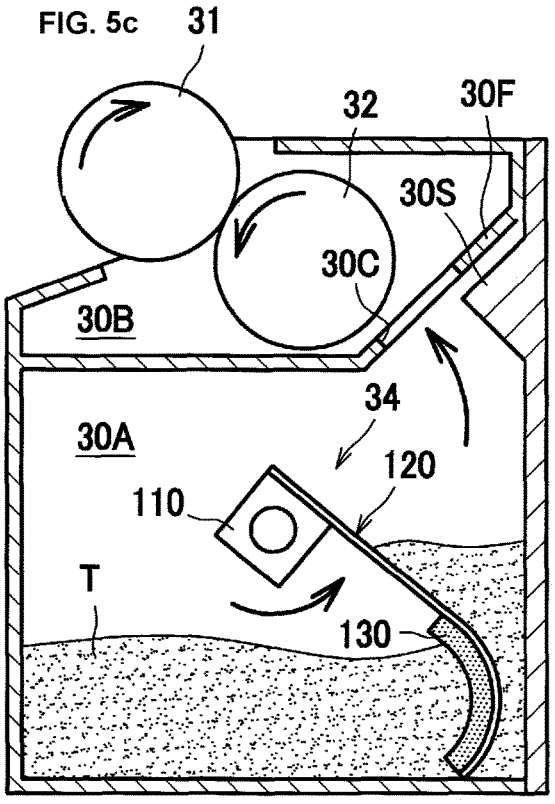

After pulling out the agitation sheet 120 from the gap between the first wall 30F and the second wall 30S, the agitation sheet 120 rotates together with the rotation of the shaft 110 to agitate toner T in the storage chamber 30A and convey the toner T toward the opening 30C as illustrated in FIG. 5C. Thus, toner T is supplied into the developing chamber 30B through the opening 30C. Toner T agitation and toner T supply are performed after pulling out the agitation sheet 120 from the gap between the first wall 30F and the second wall 30S, and the agitation sheet 120 does not enter the gap between the first wall 30F and the second wall 30S.

Toner T supplied to the developing chamber 30B is supplied to the developing roller 31 by the supply roller 32, so that the toner T is carried on the surface of the developing roller 31.

As described above, leakage of toner through the opening 30C can be restrained since the agitation sheet 120 can close the opening 30C formed in the first wall 30F without fuse bonding. Further, in case of assembling the process cartridge 1, fuse-bonding of the agitation sheet 120 to the first wall 30F is not required. Therefore, assembling workload can be decreased to enhance labor effectiveness in comparison with a conventional structure where the seal member is attached to the wall having the opening by fuse-bonding.

Further, since the elastic member 130 is positioned between the agitation sheet 120 and the second wall 30S, the agitation sheet 120 can be urged toward the first wall 30F by the elastic member 130. Hence, enhanced sealability between the agitation sheet 120 and the first wall 30F can be obtained to restrain toner leakage through the opening 30C.

Further, since the elastic member 130 is positioned at each end portion in the axial direction of the agitation sheet 120, each axially end portion of the agitation sheet 120 can be pressed against the first wall 30F by each elastic member 130. Accordingly, formation of clearance or gap between the first wall 30F and each axial end portion of the agitation sheet 120 can be restrained, to further avoid toner leakage through the opening 30C.

Further, the elastic member 130 is disposed on the second surface 120B of the agitation sheet 120, that is, the elastic member 130 is disposed on a trailing side of the agitation sheet 120 in its rotational direction about an axis of the shaft 110. Therefore, after pulling the agitation sheet 120 out of the gap between the first wall 30F and the second wall 30S, the elastic member 130 can support the agitation sheet 120 from its back in the rotational direction. If the elastic member 130 is disposed on a leading side of the agitation sheet 120 in the rotational direction, the elastic member 130 provides an uneven leading surface. According to the present invention, since the elastic member 130 is disposed on the trailing side of the agitation sheet 120 in the rotational direction, no uneven surface is provided at the leading side of the agitation sheet 120. Thus, the agitation sheet 120 can perform desired agitation of toner in the storage chamber 30A and desired toner supply to the developing chamber 30B.

Incidentally, according to the first embodiment, the elastic member 130 is fixed to the agitation sheet 120. However, other structure is conceivable. For example, the elastic member may be fixed to the second wall 30S of the developing frame 30 instead of fixing to the agitation sheet.

Further, in the first embodiment, each of the two elastic member 130 is positioned at each end portion in the axial direction of the agitation sheet 120 and one elastic member 130 is positioned at the center portion in the axial direction of the agitation sheet 120 as illustrated in FIG. 3. However, other structure is conceivable. For example, the elastic member may extend over a length of the agitation sheet in the axial direction. In the latter case, the length of the elastic member is 100% of the length of the agitation member 120 in the axial direction. That is, the length of the elastic member is equal to the length of the agitation sheet 120 in the axial direction.

Further, in the first embodiment, the end face 131 of the elastic member 130 is positioned coincident with the free end 122E of the agitation sheet 120. However, other structure is available. For example, the elastic member may be positioned away from the free end of the agitation sheet.

A second embodiment will next be described, wherein like parts and components are designated by the same reference numeral as those shown in the first embodiment for avoiding duplicating description. A structure different from the first embodiment will be described in detail.

Figure 6:
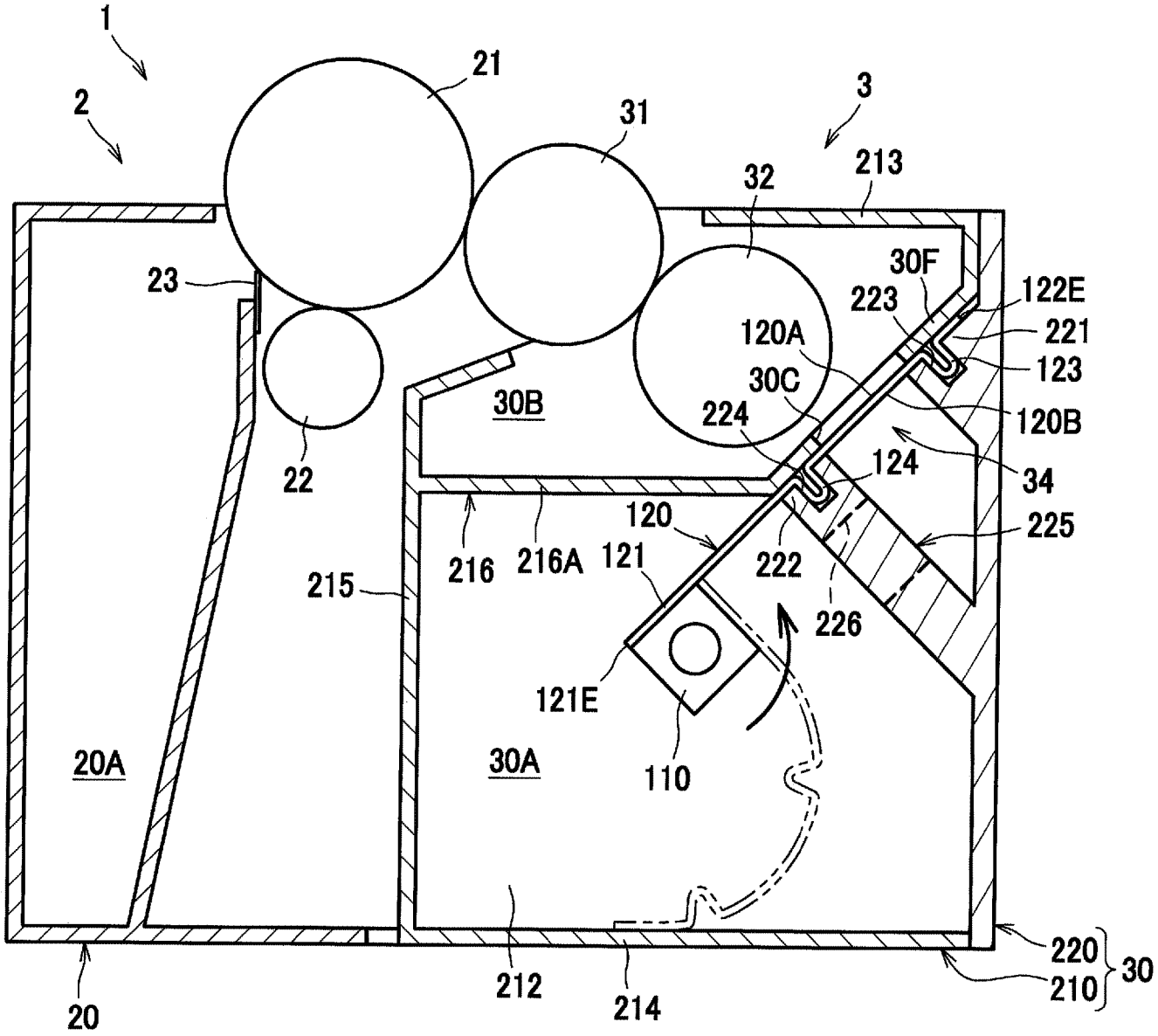
FIG. 6 is a cross-sectional view of a process cartridge according to a second embodiment.
Figure 7:
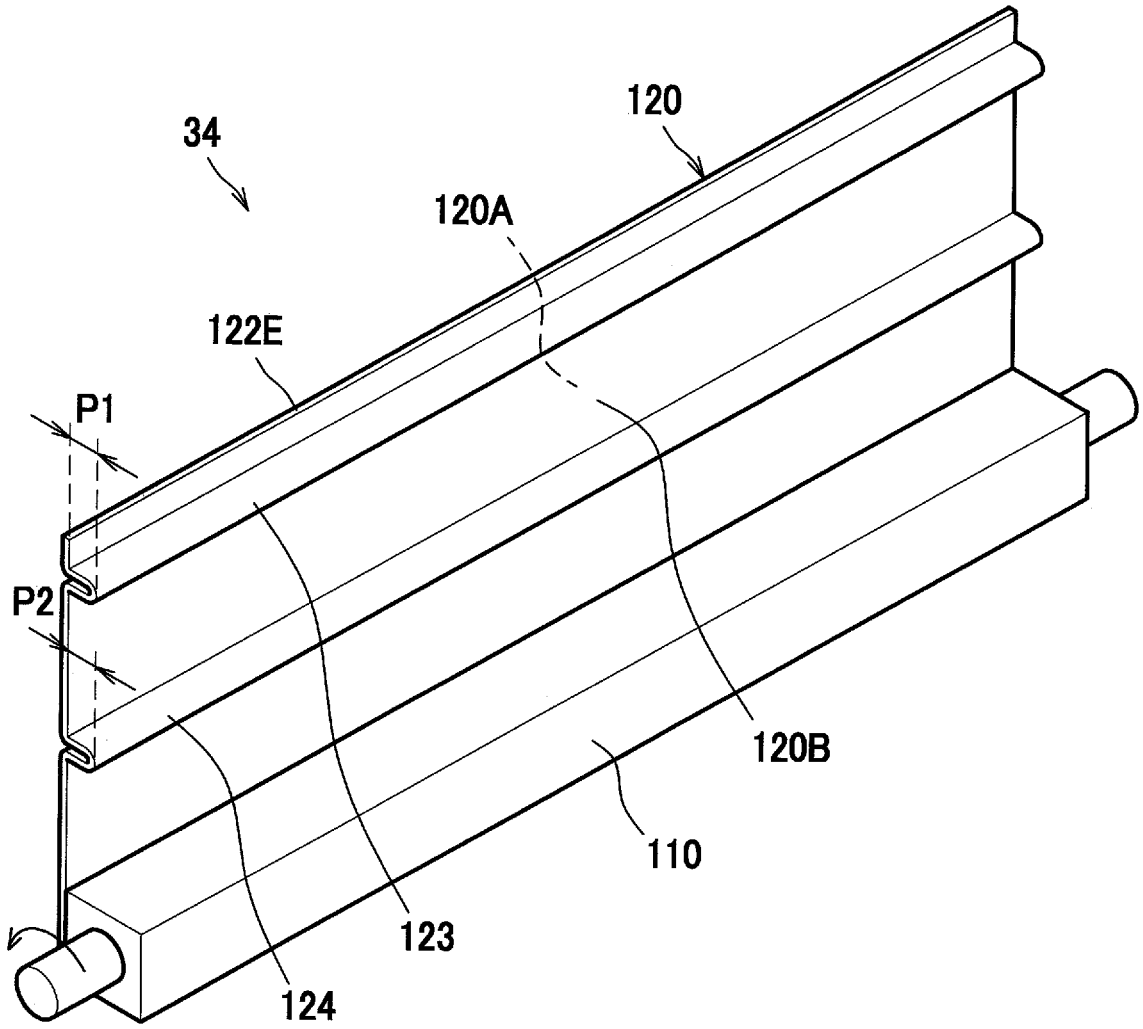
FIG. 7 is a perspective view of an agitator in the cartridge according to the second embodiment.

As illustrated in FIGS. 6 and 7, an agitator 34 according to the second embodiment does not include the elastic member 130 described in the first embodiment, but includes the shaft 110 and an agitation sheet 120. The agitation sheet 120 includes a first protruding portion 123 and a second protruding portion 124 as protruding portions.

The first protruding portion 123 and the second protruding portion 124 protrude in a direction opposite to the rotational direction of the shaft 110, i. e., protrude near side in FIG. 7. Specifically, the first protruding portion 123 and the second protruding portion 124 are formed by buckling a part of the agitation sheet 120 into U-shape. In a state where the agitation sheet 120 is nippingly supported between the first wall 30F and walls 221, 222 described later as illustrated in FIG. 6, the first protruding portion 123 is positioned to face a part of the first wall 30F, the part being positioned closer to the free end 122E than the opening 30C is to the free end 122E. That is, the first protruding portion 123 faces the upward portion of the first wall 30F upward of the opening 30C. Further, the first wall 30F and the wall 221 support the first protruding portion 123 therebetween. In the state where the agitation sheet 120 is nippingly supported between the first wall 30F and walls 221, 222, the second protruding portion 124 is positioned to face a part of the first wall 30F, the part being positioned closer to the base end 121E than the opening 30C is to the base end 121E. That is, the second protruding portion 124 faces the downward portion of the first wall 30F downward of the opening 30C. Further, the first wall 30F and the wall 222 support the second protruding portion 124 therebetween. The agitation sheet 120 includes the first protruding portion 123 and the second protruding portion 124 at positions different from each other.

Protruding amount P1 of the first protruding portion 123 and protruding amount P2 of the second protruding portion 124 is preferably in a range of from 3 to 7 mm, more preferably in a range of from 4 to 6 mm, and more preferably 5 mm. Further, protruding amounts P1 and P2 are equal to each other, or different from each other. Incidentally, protruding amounts P1, P2 are measured from the second surface 120B.

In the present embodiment, in contrast to the first embodiment, the second surface 120B of the agitation sheet 120 is in direct contact with the walls 221, 222 in a state where the agitation sheet 120 is nippingly supported between the first wall 30F and the walls 221, 222.

As illustrated in FIG. 6, a second developing frame 220 includes, as a second wall, a third wall 221 and a fourth wall 222. The third wall 221 confronts a portion of the first wall 30F, the portion being closer to the free end 122E than the opening 30C is to the free end 122E. The third wall 221 has a first recessed portion 223 as a recessed portion. The fourth wall 222 confronts a portion of the first wall 30F, the portion being closer to the base end 121E than the opening 30C is to the base end 121E. The fourth wall 222 has a second recessed portion 224 as a recessed portion. In other words, the developing frame 30 has the first recessed portion 223 engageable with the first protruding portion 123 and the second recessed portion 224 engageable with the second protruding portion 124.

The first recessed portion 223 is configured to engage the first protruding portion 123 in a state where the agitation sheet 120 is supported between the first wall 30F and the walls 221, 222. The second recessed portion 224 is configured to engage the second protruding portion 124 in the state where the agitation sheet 120 is supported between the first wall 30F and the walls 221, 222.

Figure 8:
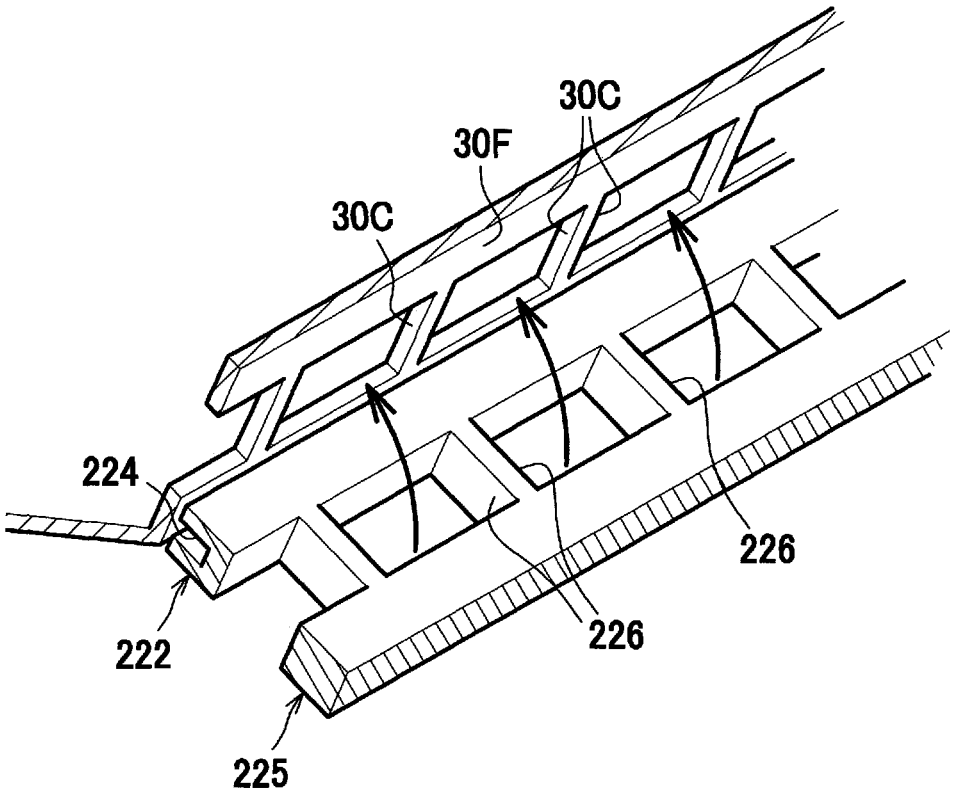
FIG. 8 is a partial perspective view illustrating a fourth wall as an example of a second wall and a connecting wall in the second embodiment.

As illustrated in FIGS. 6 and 8, the fourth wall 222 is connected to the second developing frame 220 through a connecting wall 225. The connecting wall 225 is formed with supply openings 226 through which toner is conveyed from the storage chamber 30A toward the developing chamber 30B by way of the opening 30C of the first wall 30F.

In the process of assembling the process cartridge 1 according to the present embodiment, after the agitator 34 is assembled to the first developing frame 210, the agitator 34 is rotated as needed so that the agitator 34 has a posture such that the agitation sheet 120 closes the opening 30C of the first wall 30F. In the process of attaching the second developing frame 220 to the first developing frame 210, the agitation sheet 120 is nipped between the first wall 30F and the walls 221, 222 while the first protruding portion 123 and the second protruding portion 124 of the agitation sheet 120 are engaged with the first recessed portion 223 and the second recessed portion 224, respectively.

In a state of a new cartridge, upon starting rotational movement of the agitation sheet 120 by the rotation of the shaft 120, the agitation sheet 120 is pulled, so that the first and second protruding portions 123, 124 are disengaged from the recessed portions 223, 224 permitting the protrusions to be stretchingly deformed. Thus, the agitation sheet 120 is pulled out of the gap between the first wall 30F and the walls 221, 222. After the agitation sheet 120 is completely pulled out of the gap between the first wall 30F and the walls 221,222, the opening 30C of the first wall 30F is opened providing communication between the storage chamber 30A and the developing chamber 30B through the opening 30C. Thereafter, the agitation sheet 120 rotates together with the rotation of the shaft 110 to agitate and convey the toner. The agitation sheet 120 does not enter the gap between the first wall 30F and the second wall 221, 222.

Similar to the first embodiment, according to the present embodiment described above, leakage of the toner through the opening 30C can be restrained since the agitation sheet 120 closes the opening 30C. Further, in the process of assembling the process cartridge 1, fuse-bonding of the agitation sheet 120 to the first wall 30F is not required. Therefore, assembling labor efficiency can be improved.

Further, displacement of the agitation sheet 120 at a portion between the first wall 30F and the walls 221, 222 due to vibration during transportation of the process cartridge can be restrained, since protruding portions 123, 124 of the agitation sheet 120 are engaged with recessed portions 223, 224 of the walls 221, 222 in the state where the agitation sheet 120 is supported between the first wall 30F and the walls 221, 222. Hence, covering the opening 30C by the agitation sheet 120 can be maintained to further prevent the toner from leaking through the opening 30C.

Figure 9:
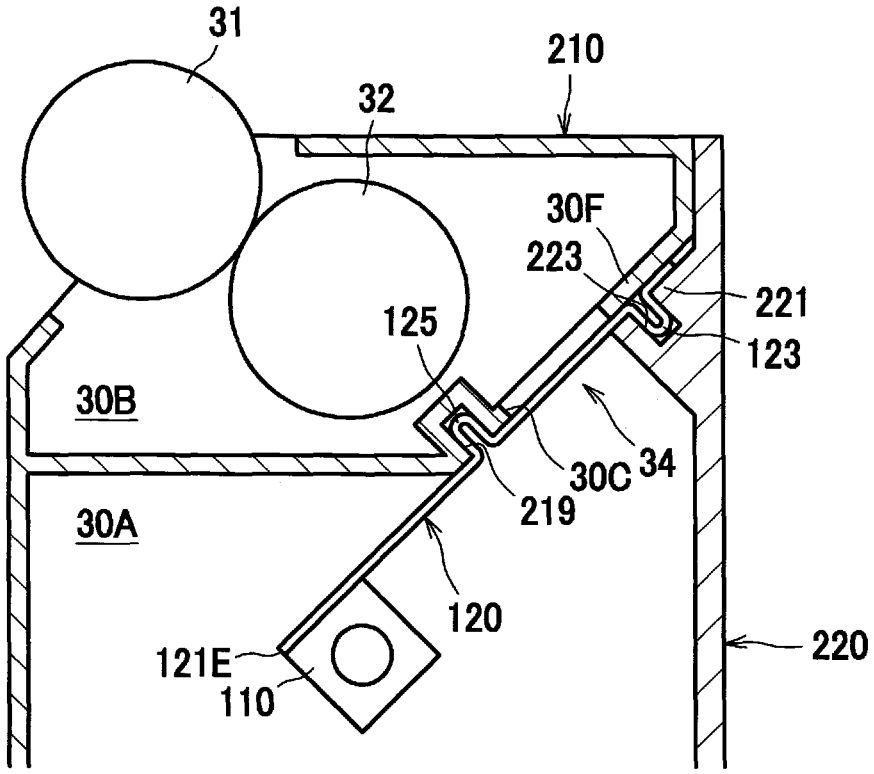
FIG. 9 is a cross-sectional view of a process cartridge according to a first modification to the second embodiment.

Incidentally, in the second embodiment, the protruding portions 123, 124 protrude in upstream direction with respect to the rotational direction of the shaft 110. However, other structure is available. For example, the protruding portions may protrude in downstream direction with respect to the rotational direction of the shaft 110. For example, in an embodiment illustrated in FIG. 9, the second protruding portion 125 protrudes toward the developing chamber 30B, i.e., protrudes in downstream direction with respect to the rotational direction of the shaft 110 in the state where the agitation sheet 120 is supported between the first wall 30F and the third wall 221. In this embodiment, the second recessed portion 219 engageable with the second protruding portion 125 is formed in the first wall 30F at a position closer to the base end 121E than the opening 30C is to the base end 121E. With this structure, because of the engagement between the second protruding portion 125 and the second recessed portion 219, creepage distance from the storage chamber 30A to the opening 30C can be elongated at a contacting region between the agitation sheet 120 and a portion of the first wall 30F, the portion being closer to the base end 121E than the opening 30C is to the base end 121E. Thus, leakage of the toner can further be restrained.

Figure 10:
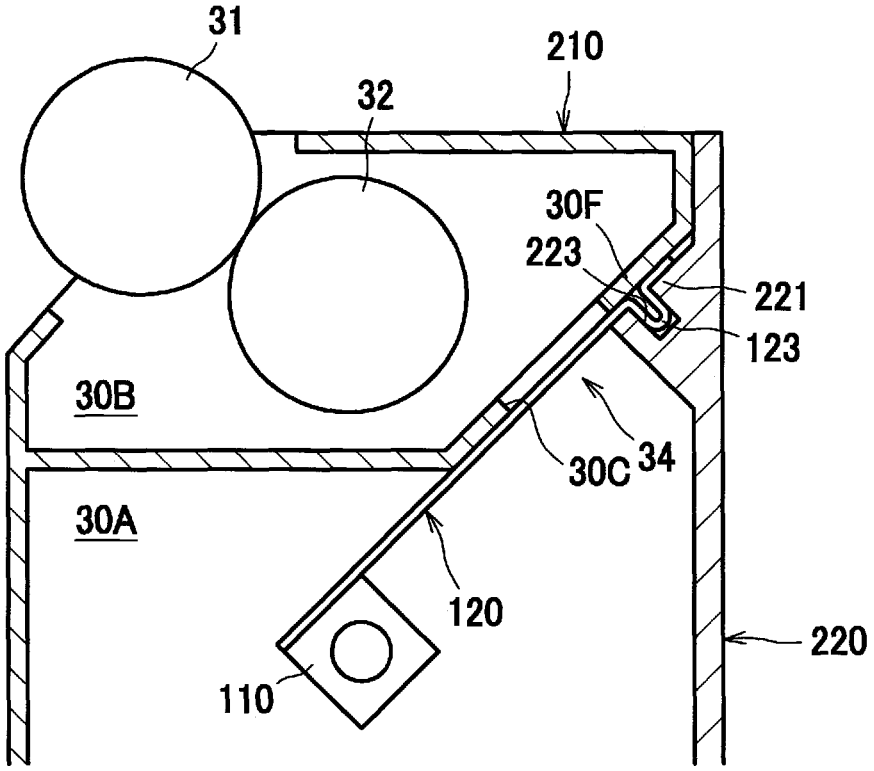
FIG. 10 is a cross-sectional view of a process cartridge according to a second modification to the second embodiment.

Further, according to the second embodiment, the developing frame 30 includes, as the second wall, two walls 221, 222, and the agitation sheet 120 includes two protruding portions 123, 124 engageable with two recessed portions 223, 224 formed in the walls 221, 222. However, other structure is available. For example, as illustrated in FIG. 10, the developing frame 30 includes only the third wall 221 as the second wall. That is, the developing frame may not include the fourth wall 222 and the connection wall 225 those illustrated in FIG. 6. In this case, the agitation sheet 120 may include a single protruding portion 123 engageable with the recessed portion 223 formed with third wall 221. That is, the first protruding portion 123 is only provided at a position facing a portion of the first wall 30F above the opening 30C.

While the invention has been described with reference to the embodiments, the invention is not limited to the above-described embodiments, but various modifications are conceivable without departing from the scope of the invention.

For example, the agitation sheet 120 as the flexible sheet is provided with the elastic member 130 in the first embodiment, and protruding portions 123, 124 are formed in the agitation sheet 120 in the second embodiment. However, other structure is available. For example, the flexible sheet may not be provided with the elastic member or may not include protruding portion. In the latter cases, the flexible sheet can be pulled out from the portion between the first wall and the second wall with a relatively small force by the rotation of the shaft, and therefore, load imparted on the drive source such as a motor for rotating the shaft can be reduced, This is in contrast to the conventional structure where high load may be imparted for peeling off the seal member that is fuse-bonded to the wall forming the opening.

Further, according to the above-described embodiments, the agitation sheet 120 of the agitator 34 is exemplified as the flexible sheet. However, other structure is available. For example, the flexible sheet may be a sheet like member supported by the shaft and differently constructed from an agitation sheet of the agitator as described in Patent Document 1.

Further, in the above-described embodiments, the process cartridge 1 provided with the drum unit 2 and the developing unit 3 is exemplified as the toner cartridge. However, other structure is available. For example, the toner cartridge may not include the drum unit 2 but only includes the developing unit 3 with reference to FIG. 1. Alternatively, the toner cartridge may not include the drum unit 2, the developing roller 31, and the supply roller 32, but only include the casing forming the storage chamber 30A and the agitator 34.

DESCRIPTION OF REFERENCE NUMERALS

1 process cartridge
30 developing frame
30A storage chamber
30B developing chamber
30C opening
30F first wall
30S second wall
110 shaft
120 agitation sheet
120A first surface
120B second surface
121 base end portion
122E free end

130 elastic member

T toner

The invention claimed is:

1. A toner cartridge comprising:

a casing having a storage chamber configured to store therein toner and formed with an opening to discharge the toner out of the storage chamber;

a shaft rotatably supported to the casing; and a flexible sheet positioned in the storage chamber, and having a base end portion supported to the shaft, the flexible sheet being rotationally movable along with rotation of the shaft;

wherein the casing comprises a first wall formed with the opening, and a second wall configured to contact with the flexible sheet while permitting the flexible sheet to be in contact with the first wall by nipping, in cooperation with the first wall, the flexible sheet positioned to close the opening, to support, in cooperation with the first wall, the flexible sheet positioned to close the opening;

wherein the flexible sheet has a protruding portion provided by buckling a part of the flexible sheet and wherein the flexible sheet has a supported region different from the protruding portion, the supported region being supported by a portion of the casing.

2. The toner cartridge according to claim 1, further comprising an elastic member provided at a position between the flexible sheet and the second wall.

3. The toner cartridge according to claim 2, wherein the elastic member has a total length in an axial direction of the shaft, the length being ranging from 10% to 100% of the length of the flexible sheet in the axial direction.

4. The toner cartridge according to claim 2, wherein the elastic member has a contact surface in contact with the flexible sheet, the contact surface having an area ranging from 2% to 50% of an area of the flexible sheet.

5. The toner cartridge according to claim 2, wherein the elastic member is positioned at each end portion of the flexible sheet in an axial direction of the shaft.

6. The toner cartridge according to claim 2, wherein the flexible sheet has a first surface in contact with the first wall, and a second surface opposite to the first surface and facing the second wall in a state where the flexible sheet is supported by the second wall, the elastic member being positioned at the second wall.

7. The toner cartridge according to claim 2, wherein the elastic member is made from urethane foam.

8. The toner cartridge according to claim 1, wherein the first wall and the second wall are configured to support the protruding portion.

9. The toner cartridge according to claim 1, wherein the casing has a recessed portion with which the protruding portion is engageable.

10. The toner cartridge according to claim 2, wherein the elastic member has a first end face in contact with the flexible sheet and a second end face in contact with the second wall.

11. A toner cartridge comprising:

a casing having a storage chamber configured to store therein toner and formed with an opening to discharge the toner out of the storage chamber;

a shaft rotatably supported to the casing; and a flexible sheet positioned in the storage chamber, and having a base end portion supported to the shaft, the flexible sheet being rotationally movable along with rotation of the shaft; and an elastic member provided at a position between the flexible sheet and the second wall;

wherein the casing comprises a first wall formed with the opening, and a second wall configured to contact with the flexible sheet while permitting the flexible sheet to be in contact with the first wall by nipping, in cooperation with the first wall, the flexible sheet positioned to close the opening, to support, in cooperation with the first wall, the flexible sheet positioned to close the opening;

wherein the elastic member is positioned at a free end portion of the flexible sheet; and wherein the elastic member has a length in a perpendicular direction perpendicular to an axial direction of the shaft, the length being ranging from 15% to 70% of the length of the flexible sheet in the perpendicular direction.

12. A toner cartridge comprising:

a casing having a storage chamber configured to store therein toner and formed with an opening to discharge the toner out of the storage chamber;

a shaft rotatably supported to the casing; and a flexible sheet positioned in the storage chamber, and having a base end portion supported to the shaft, the flexible sheet being rotationally movable along with rotation of the shaft;

wherein the casing comprises a first wall formed with the opening, and a second wall configured to contact with the flexible sheet while permitting the flexible sheet to be in contact with the first wall by nipping, in cooperation with the first wall, the flexible sheet positioned to close the opening, to support, in cooperation with the first wall, the flexible sheet positioned to close the opening;

wherein the flexible sheet has a protruding portion provided by buckling a part of the flexible sheet;

wherein the casing has a recessed portion with which the protruding portion is engageable; and wherein the recessed portion is positioned to face an area lower than the opening.

13. A toner cartridge comprising:

a casing having a storage chamber configured to store therein toner and formed with an opening to discharge the toner out of the storage chamber;

a shaft rotatably supported to the casing; and a flexible sheet positioned in the storage chamber, and having a base end portion supported to the shaft, the flexible sheet being rotationally movable along with rotation of the shaft;

wherein the casing comprises a first wall formed with the opening, and a second wall configured to contact with the flexible sheet while permitting the flexible sheet to be in contact with the first wall by nipping, in cooperation with the first wall, the flexible sheet positioned to close the opening, to support, in cooperation with the first wall, the flexible sheet positioned to close the opening;

wherein the flexible sheet has a protruding portion provided by buckling a part of the flexible sheet;

wherein the casing has a recessed portion with which the protruding portion is engageable; and wherein the recessed portion is positioned to face an area higher than the opening.

* * * * *